US007770417B2

(12) United States Patent
Lonati et al.

(10) Patent No.: US 7,770,417 B2
(45) Date of Patent: Aug. 10, 2010

(54) MAGNETIC ACTUATOR, PARTICULARLY FOR SELECTION DEVICES IN HOSIERY KNITTING MACHINES OR THE LIKE

(75) Inventors: Tiberio Lonati, Brescia (IT); Fausto Lonati, Brescia (IT); Ettore Lonati, Botticino (IT)

(73) Assignee: Santoni S.p.A., Brescia (IT)

( * ) Notice: Subject to any disclaimer, the term of this patent is extended or adjusted under 35 U.S.C. 154(b) by 0 days.

(21) Appl. No.: 12/084,700

(22) PCT Filed: Nov. 18, 2005

(86) PCT No.: PCT/EP2005/012394

§ 371 (c)(1),
(2), (4) Date: Jul. 7, 2008

(87) PCT Pub. No.: WO2007/057042

PCT Pub. Date: May 24, 2007

(65) Prior Publication Data

US 2009/0139272 A1 Jun. 4, 2009

(51) Int. Cl.
*D04B 15/78* (2006.01)

(52) U.S. Cl. ..... 66/219

(58) Field of Classification Search ..... 66/15, 66/19, 20, 246–221
See application file for complete search history.

(56) References Cited

U.S. PATENT DOCUMENTS

| | | | | |
|---|---|---|---|---|
| 3,454,838 | A | 7/1969 | Defain | |
| 4,715,198 | A * | 12/1987 | Ploppa et al. | 66/75.2 |
| 5,197,303 | A * | 3/1993 | Aria | 66/217 |
| 5,983,677 | A * | 11/1999 | Shibata | 66/219 |
| 6,014,875 | A | 1/2000 | Lonati et al. | |
| 6,178,786 | B1 * | 1/2001 | Willmer | 66/221 |
| 6,584,810 | B2 * | 7/2003 | Nakahata et al. | 66/75.2 |

FOREIGN PATENT DOCUMENTS

DE 44 42 405 C1 1/1996

* cited by examiner

*Primary Examiner*—Danny Worrell
(74) *Attorney, Agent, or Firm*—Modiano & Associati; Albert Josif; Daniel J. O'Byrne

(57) ABSTRACT

A magnetic actuator, particularly for selection devices in hosiery knitting machines or the like, comprising a main magnet, which has at least two poles arranged side by side and separated by a discontinuity, and a selection electromagnet, which is provided with at least one pole arranged in alignment with the discontinuity and spaced laterally with respect to it. The selection electromagnet can be actuated to generate or eliminate or reduce a magnetic attraction force at the pole of the selection electromagnet.

38 Claims, 6 Drawing Sheets

MAGNETIC ACTUATOR, PARTICULARLY FOR SELECTION DEVICES IN HOSIERY KNITTING MACHINES OR THE LIKE

TECHNICAL FIELD

The present invention relates to a magnetic actuator particularly for selection devices in hosiery knitting machines or the like.

BACKGROUND ART

Magnetic actuators for selection devices in hosiery knitting machines or the like are known.

Generally, these magnetic actuators are composed substantially of a main magnet, which has two poles arranged side by side and separated by a discontinuity, and a selection electromagnet, which is provided with a ferromagnetic core with at least one pole located at the discontinuity between the two poles of the main magnet. The selection electromagnet is equipped with a coil, which can be supplied with electric power in order to eliminate or reduce substantially the magnetic attraction force of the pole of the core of the selection electromagnet induced by the main magnet.

Selection devices which use these magnetic actuators generally comprise a plurality of selection elements, made of a material which can be attracted magnetically, which can move with respect to the magnetic actuator along an actuation direction and which, in their motion, face the poles of the main magnet and of the core of the selection electromagnet.

The magnetic actuator is arranged on the machine so that the poles are arranged sequentially along the direction of actuation of the selection elements so that said elements, in their motion along the actuation direction, face in succession, with one of their sides, first one of the poles of the main magnet and then the discontinuity and the pole of the core of the selection electromagnet and finally the other pole of the main magnet.

Moreover, the selection elements can move from a first position, in which they are adjacent to, or even in contact with, said poles, to a second position, in which they are spaced from the poles with respect to the first position. This mobility of the selection elements in the two positions corresponds to two different actuations of the elements of the machine, generally needles, which must be selected by means of the selection device.

In practice, in many cases the movement of the selection elements from the second position to the first position is contrasted by an elastic element, which tends to keep the corresponding selection element in the second position. Upstream of the magnetic actuator, an abutment, constituted generally by a cam, acts on the selection elements so that they all reach the first position directly ahead of, or at, the first pole of the main magnet which retains the selection elements in this position until the discontinuity begins. At the discontinuity, if the coil is supplied with electric power, the attraction force of the core of the selection electromagnet generated by the main magnet is eliminated or substantially reduced to such an extent as to be insufficient to contrast the force of the elastic element which causes the transfer of the selection element into the second position, in which it remains also during transit at the second pole of the main magnet, the attraction force of which is in itself insufficient to cause the transfer of the selection element from the second position to the first position. If, vice versa, the coil of the selection electromagnet is not supplied with power, the core of the selection electromagnet retains in the first position the selection element, which remains in this position and is kept in said first position also during transit at the second pole of the main magnet.

The selection element, depending on whether it is in the first position or in the second position, consequently engaging or not other elements of the machine, causes a different actuation of the element, generally a needle, of the machine which is correlated thereto, achieving the required selection.

In magnetic actuators of this kind, difficulties are observed in sizing and feeding the coil of the selection electromagnet, since in order to achieve a precise effect on the selection elements the intensity of the magnetic field induced by the electric power supply of the coil must be, at the discontinuity, i.e., at the pole of the core of electromagnet, substantially equal and opposite with respect to that of the permanent magnetic field induced in the core of the selection electromagnet by the main magnet. If the intensity of the magnetic field induced by the power supply of the coil is significantly lower than, or higher than, the intensity of the permanent magnetic field induced in the core of the selection electromagnet, the pole of the core of the selection electromagnet still applies an attraction of the selection element, obtaining an effect which is the opposite of the intended one.

The sizing and power supply of the coil of the selection electromagnet in known types of magnetic actuators are complicated, since the intensity of the magnetic field induced at the pole of the selection electromagnet, and therefore the attraction force applied by this pole to the selection element, varies according to the number of selection elements which are in contact with, or adjacent to, the poles of the main magnet, since the selection elements produce, due to their presence, a variation of the magnetic field of the main magnet, which in turn causes variations of the magnetic field induced in the core of the selection electromagnet located inside the main magnet, at the discontinuity, between its poles.

In known types of magnetic actuators, in order to avoid selection errors, it would be necessary to supply the coil of the selection electromagnet with a current whose intensity can vary according to the various selection conditions, with considerable increases as regards the management of the actuation of the magnetic actuators.

Moreover, magnetic actuators, in the specific application to selection devices, must not hinder the positioning of other elements required for the operation of the machine. For this reason, the design of these magnetic actuators has always been oriented toward containing the overall space occupation of the magnetic actuator. This goal, in known types of magnetic actuators, is achieved by using small main magnets, which accordingly have a low power, with the consequence of having very small gaps which are comparable with the processing and assembly tolerances.

This fact forces high precision in production and assembly of magnetic actuators, which increases the corresponding costs and makes it difficult to obtain a constant behavior among magnetic actuators of equal power.

On the other hand, in order to have larger gaps and therefore solve this problem, one might consider increasing the power of the main magnet, but this, due to the way in which known types of magnetic actuators are designed, would force an increase in the dimensions of the coil of the selection electromagnet, generating other problems in terms of space occupation of the magnetic actuator.

DISCLOSURE OF THE INVENTION

The aim of the present invention is to solve the problems described above by providing a magnetic actuator particularly for selection devices in hosiery knitting machines or the like which is simpler to manufacture and actuate with respect to known types of magnetic actuators.

Within this aim, an object of the invention is to provide a magnetic actuator which is affected, to a considerably smaller extent than known types of magnetic actuators, by the various selection conditions and therefore ensures high reliability and precision in operation without requiring excessive precision in the power supply and sizing of the electrical actuation components.

Another object of the invention is to provide a magnetic actuator which can be provided with considerably greater dimensional and assembly tolerances than known types of magnetic actuators.

Another object of the invention is to provide a magnetic actuator which can utilize better the magnetic characteristics of the materials of which it is made.

This aim and these and other objects, which will become better apparent hereinafter, are achieved by a magnetic actuator particularly for selection devices in hosiery knitting machines or the like, which comprises a main magnet which has at least two poles arranged side by side and separated by a discontinuity, characterized in that it comprises a selection electromagnet, which is provided with at least one pole arranged in alignment with said discontinuity and spaced laterally with respect to said discontinuity, said selection electromagnet being actuatable to generate or eliminate or reduce a magnetic attraction force at said pole of the selection electromagnet.

BRIEF DESCRIPTION OF THE DRAWINGS

Further characteristics and advantages of the invention will become better apparent from the description of two preferred but not exclusive embodiments of the magnetic actuator according to the invention, illustrated by way of non-limiting example in the accompanying drawings, wherein.

WAYS OF CARRYING OUT THE INVENTION

Figure 1:
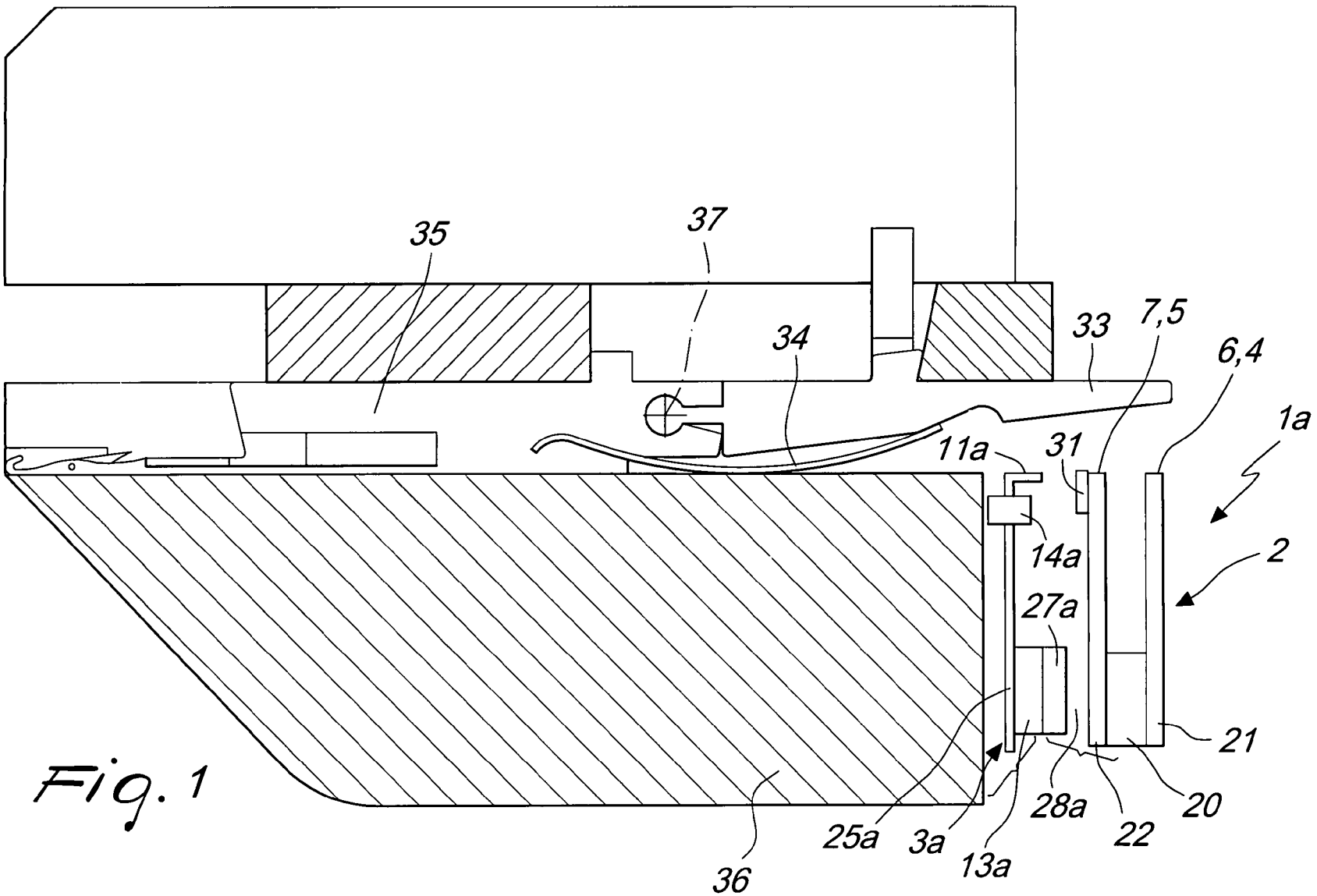
FIG. 1 is a side elevation view of the magnetic actuator according to the invention in a first embodiment, applied to a device for selecting needles of the dial of a circular knitting machine.
Figure 2:
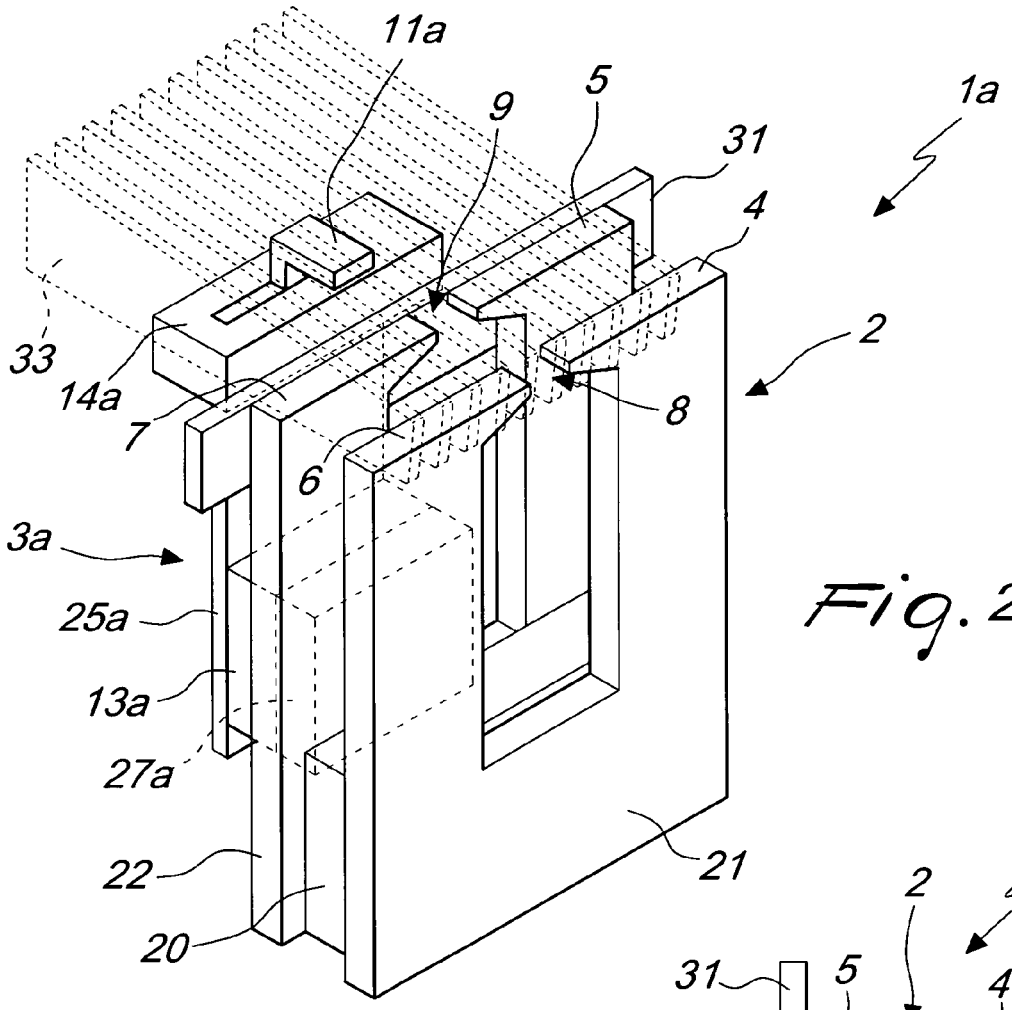
FIG. 2 is a perspective view of the magnetic actuator in the first embodiment.
Figure 3:
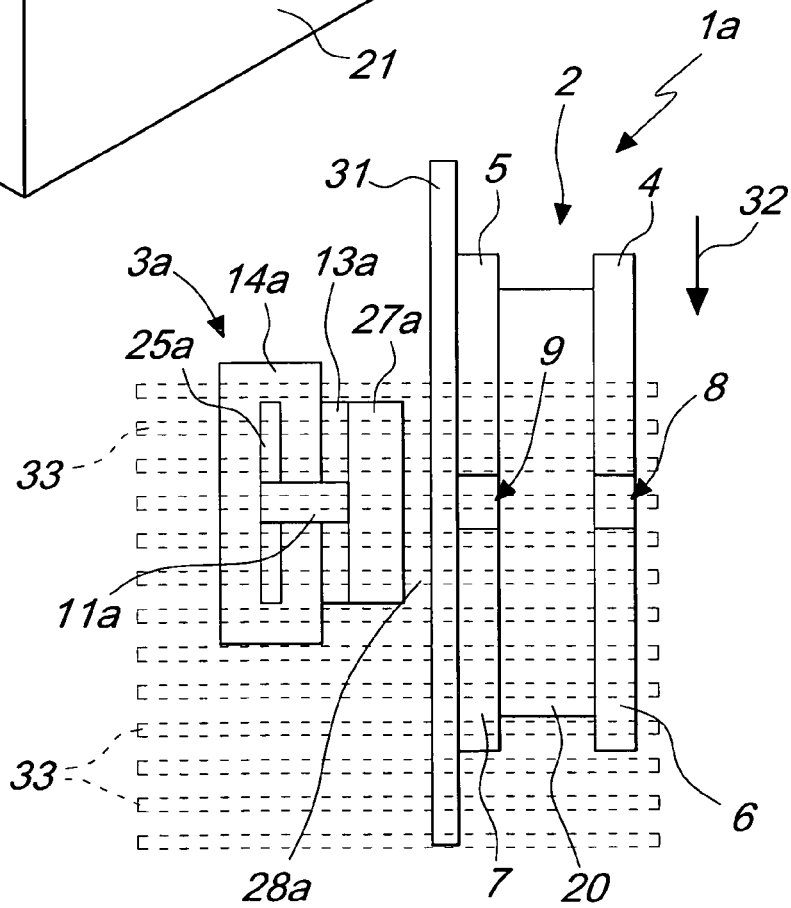
FIG. 3 is a top plan view of the magnetic actuator in the first embodiment.

With reference to the cited figures, the magnetic actuator according to the invention, generally designated in the two embodiments by the reference numerals 1*a* and 1*b*, comprises a main magnet 2 and a selection electromagnet 3*a*, 3*b*.

The main magnet 2, in both of the illustrated embodiments, has at least two poles 4, 5 and 6, 7 which are arranged side by side and separated by a discontinuity 8, 9.

The selection electromagnet 3*a*, 3*b* is provided with at least one pole 11*a*, 11*b*, 12*b*, which is aligned with the discontinuity 8, 9 of the main magnet 2.

The selection electromagnet 3*a*, 3*b* comprises a permanent magnet 13*a*, 13*b* and at least one control or actuation coil 14*a*, 14*b*, which can be supplied with electric power in order to reduce or eliminate the magnetic attraction force of the pole 11*a*, 11*b*, 12*b* of the selection electromagnet 3*a*, 3*b*.

The pole 11*a*, 11*b*, 12*b* of the selection electromagnet 3*a*, 3*b* is spaced laterally with respect to the discontinuity 8, 9 of the main magnet 2.

Conveniently, the entire selection electromagnet 3*a*, 3*b* is spaced laterally with respect to the main magnet 2.

More particularly, the main magnet 2, in both of the illustrated embodiments, comprises a permanent magnet 20, which is sandwiched between two yokes 21, 22 which form, with their ends, two pairs of poles, respectively a first pair of poles 4, 5 and a second pair of poles 6, 7, in which the poles 4, 6 are formed by the yoke 21 and the poles 5, 7 are formed by the yoke 22. The poles 4, 6 of the yoke 21 are separated by a corresponding discontinuity 8 and likewise the poles 5, 7 of the yoke 22 are separated by a corresponding discontinuity 9.

Each of the two yokes 21, 22 of the main magnet 2 is substantially U-shaped, with the discontinuity 8, 9 formed between the two free ends of the U-shape.

The permanent magnet 20 of the main magnet 2 is interposed between the two yokes 21, 22 proximate to the end at which the two arms of each U-shape of the two yokes are connected.

In the first embodiment, the selection electromagnet 3*a* comprises the permanent magnet 13*a*, which is connected to a yoke 25*a*, which forms, with one of its ends, the pole 11*a*, which is aligned with, but spaced laterally from, the discontinuity 8, 9 of the main magnet 2.

The permanent magnet 13*a* of the selection electromagnet 3*a* is preferably connected to the yoke 25*a* proximate to its end which lies opposite the end that forms the pole 11*a*.

The end of the yoke 25*a* that forms the pole 11*a* is preferably folded toward the main magnet 2.

The yoke 25*a* is arranged laterally to the yoke 22 of the main magnet 2 and the permanent magnet 13*a* of the selection electromagnet 3*a* is arranged at such a distance from the yoke 22 that it can use the yoke 22 to close the magnetic circuit of the selection electromagnet 3*a*. In practice, the yoke 22 is "connected", by means of a gap 28*a*, to the permanent magnet 13*a* of the selection electromagnet 3*a* and acts as a second yoke of the selection electromagnet 3*a*.

Optionally, the yoke 25*a* can be spaced further from the yoke 22 by applying, to the face of the permanent magnet 13*a* of the selection electromagnet 3*a* that is directed toward the main magnet 2, a connecting element 27*a* made of ferromagnetic material, which "connects", across or through the gap 28*a*, the selection electromagnet 3*a* to the yoke 22 of the main magnet 2 which lies proximate to the selection electromagnet 3*a*.

In the second embodiment, the selection electromagnet 3*b* comprises the permanent magnet 13*b*, which is sandwiched between two yokes 29*b*, 30*b*, which form, with their end, the two poles 11*b*, 12*b*, which are aligned with each other and with the discontinuity 8, 9 of the main magnet 2 but are spaced laterally with respect to the discontinuity 8, 9.

The two poles 11*b*, 12*b* of the selection electromagnet 3*b* are preferably arranged mutually side by side along a direction which is substantially perpendicular to the direction along which the poles formed by each one of the yokes 21, 22 of the main magnet 2 are arranged side by side.

The coil 14*b* of the selection electromagnet 3*b* is preferably wound around the permanent magnet 13*b* between the two yokes 29*b*, 30*b*.

Conveniently, in both of the embodiments of the magnetic actuator according to the invention, there is a supporting element 31, made of diamagnetic material, which is preferably applied to the yoke 22 or 21 of the main magnet 2 directed toward the selection electromagnet 3*a*, 3*b*.

Said supporting element 31 forms a contact surface for the selection elements which must be actuated by means of the actuator, preventing them, despite being attracted, from making direct contact with the poles of the main magnet 2 and of the selection electromagnet 3*a*, 3*b*, as will become better apparent hereinafter.

The magnetic actuator 1*a*, 1*b* according to the invention is designed to be used preferably in selection devices for hosiery knitting machines or the like, with the two poles or the two pairs of poles of the main magnet 2 arranged sequentially, in a substantially coplanar position, along an actuation direction, indicated by the arrow 32, so that they face selection elements 33, made of a material that can be attracted magnetically, which can move along said actuation direction 32 with respect to the selection magnetic actuator 1*a*, 1*b*. In this manner, the selection elements 33 face sequentially a first pole or a first pair of poles 4, 5 of the main magnet 2, then the discontinuity 8, 9 and the pole 11*a* of the selection electromagnet 3*a* or the pair of poles 11*b*, 12*b* of the selection electromagnet 3*b* and then a second pole or second pair of poles 6, 7 of the main magnet 2.

The selection elements 33 can move from a first position, in which they are kept adjacent to the poles by the magnetic attraction applied by said poles, to a second position, in which they are further spaced from the poles with respect to the first position.

Each selection element 33, in order to pass from the first position to the second position and vice versa, can move on a plane which is perpendicular to the actuation direction 32, and the movement from the second position to the first position is contrasted by an elastic means, which can be constituted by a spring 34.

Without altering the fact that the magnetic actuator according to the invention can also be used with other types of selection devices, merely by way of example, and only in order to clarify its actuation, the operation of the magnetic actuator according to the invention is explained hereinafter with reference to a device for selecting the needles 35 of the dial 36 of a circular knitting machine, of the type disclosed in U.S. Pat. No. 6,014,875 A by the same Applicant, which uses as selection elements 33 levers which are pivoted, about a pivoting axis 37, to the end of the corresponding needle that lies opposite with respect to the tip and can oscillate about said pivoting axis 37 in order to pass from the first position to the second position and vice versa.

Figure 4:
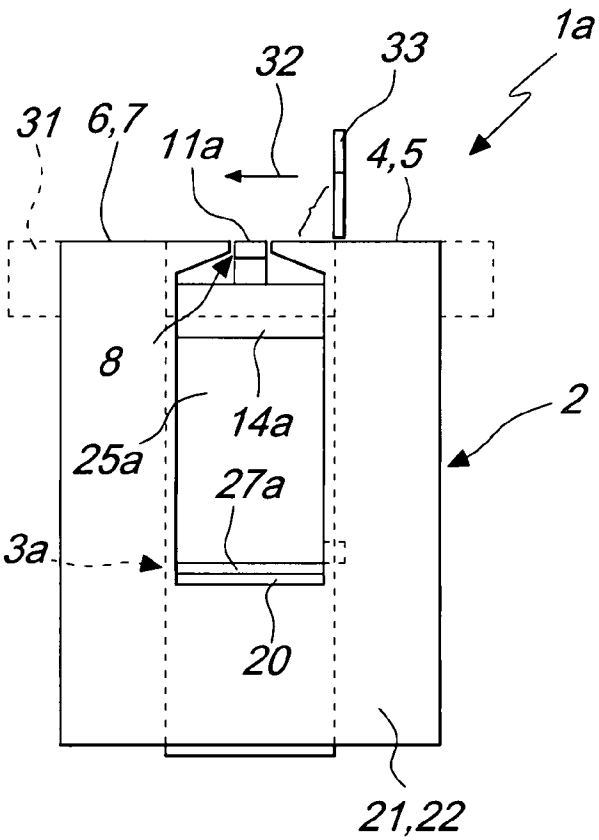
Figure 7:
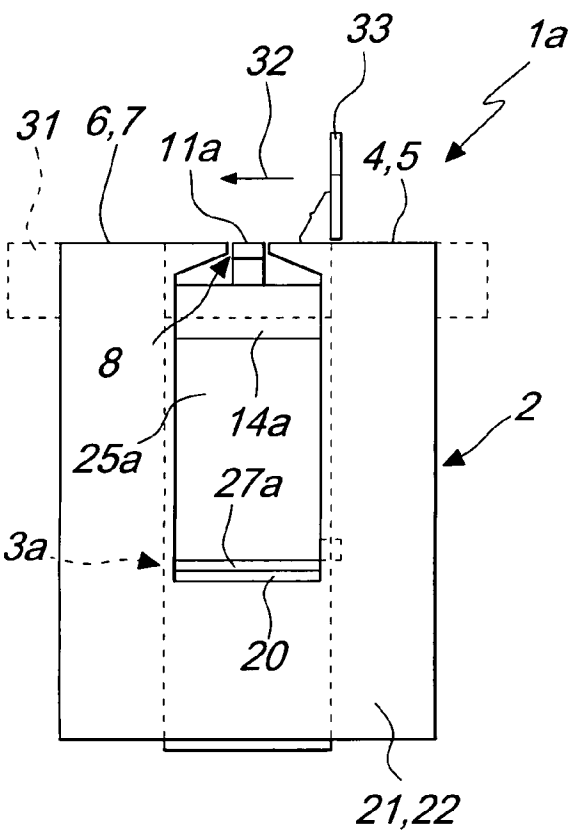
Figure 10:
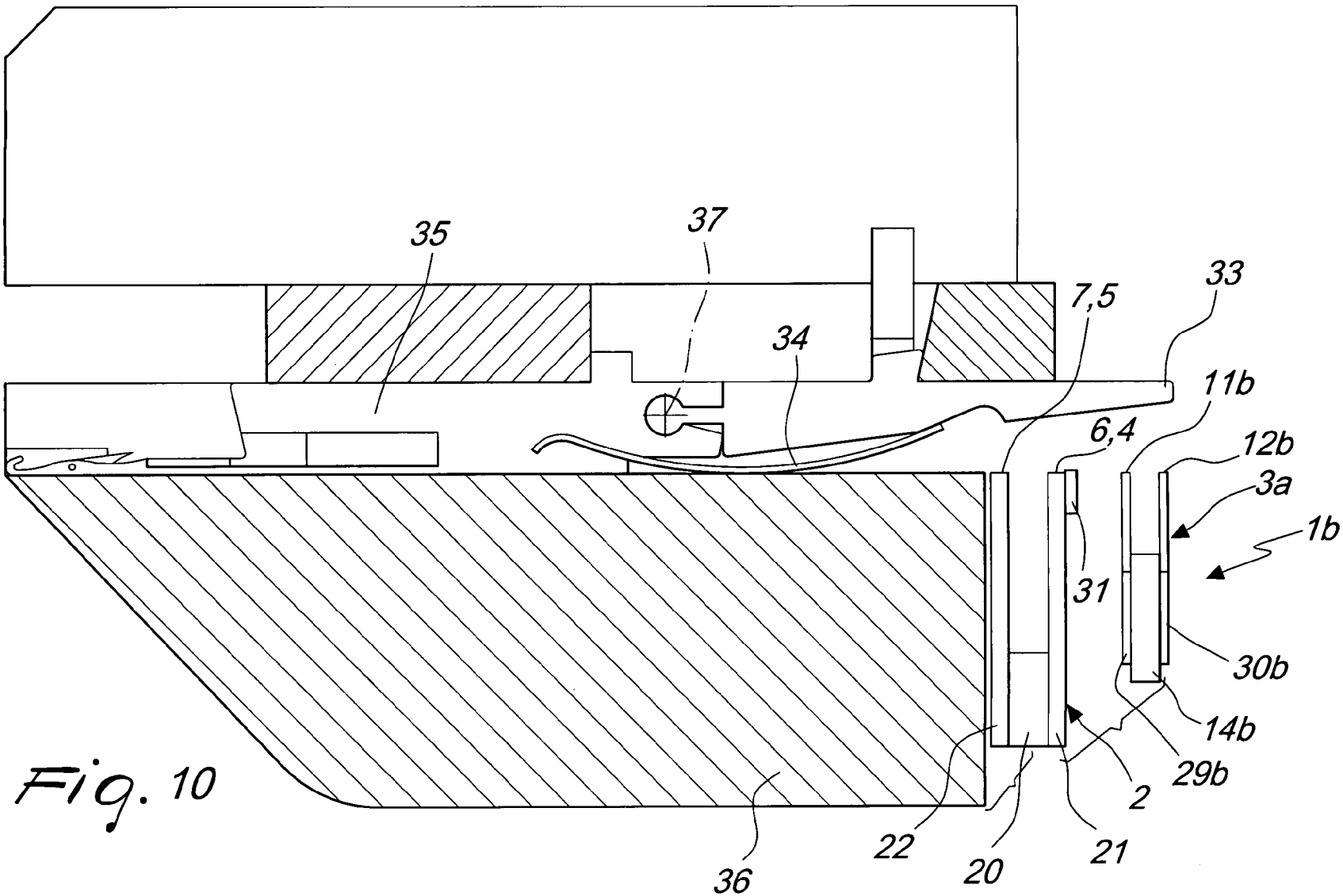
FIG. 10 is a side elevation view of the magnetic actuator according to the invention in a second embodiment, applied to a needle selection device of the dial of a circular knitting machine.
Figure 11:
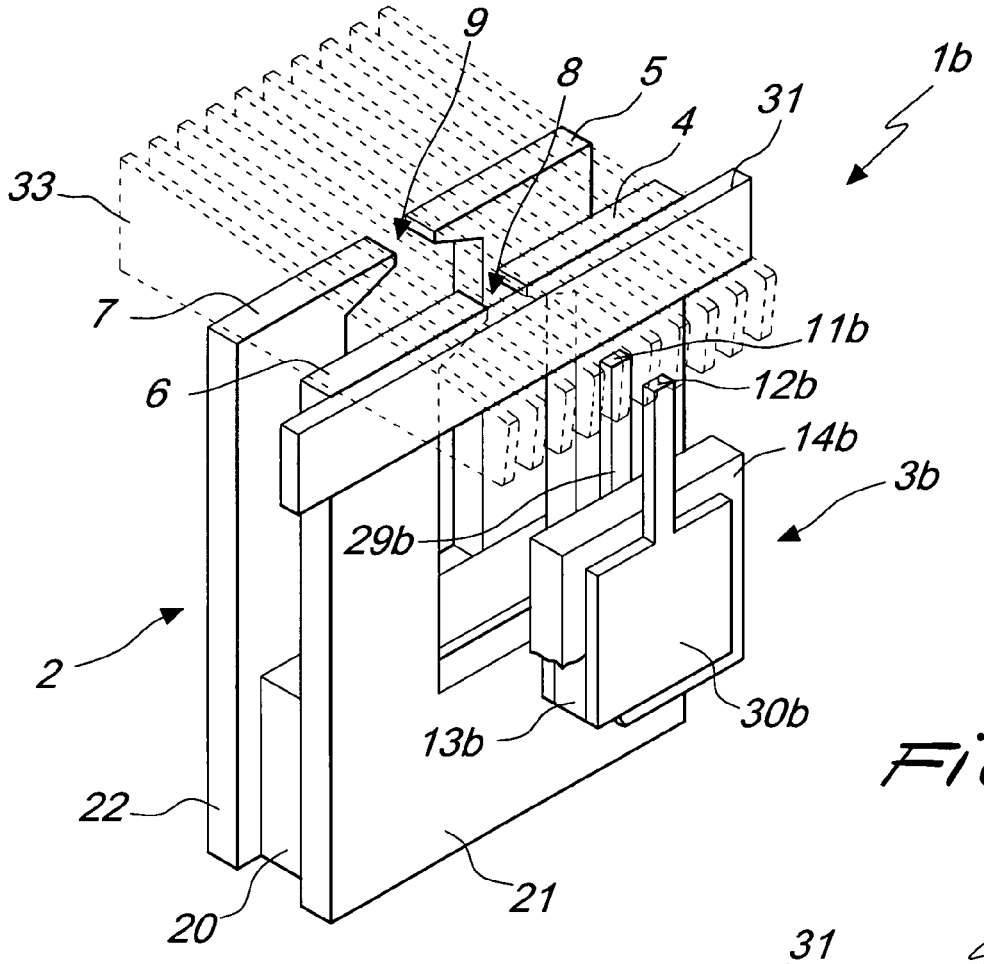
FIG. 11 is a perspective view of the magnetic actuator in its second embodiment.
Figure 12:
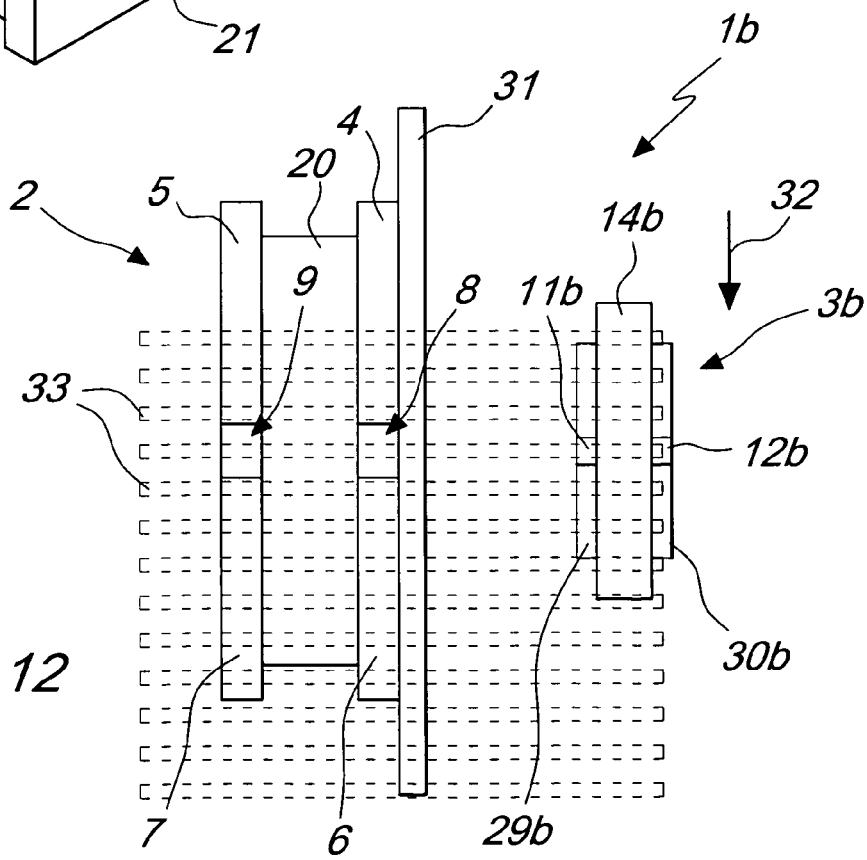
FIG. 12 is a top plan view of the magnetic actuator in its second embodiment.

With a magnetic actuator 1*a* according to the invention, in the first embodiment, each selection element 33 is moved along the actuation direction 32 with respect to the magnetic actuator 1*a*. Before reaching the first pole or first pair of poles 4, 5 of the main magnet 2 or thereat, an abutment, constituted for example by a cam, acts on the selection element 33, moving it from the second position to the first position, i.e., pushing it toward said poles 4, 5, which as a consequence of their magnetic attraction retain said selection element 33 in the first position, as shown in FIGS. 4, 7.

Figure 6:
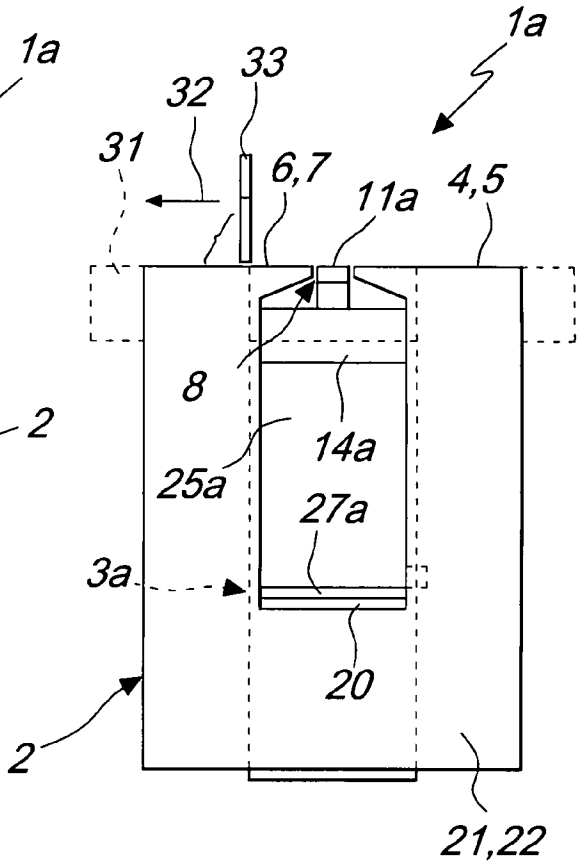
FIGS. 4 to 6 illustrate an actuation sequence of a selection element with the magnetic actuator according to the invention in the first embodiment shown in front view.
Figure 5:
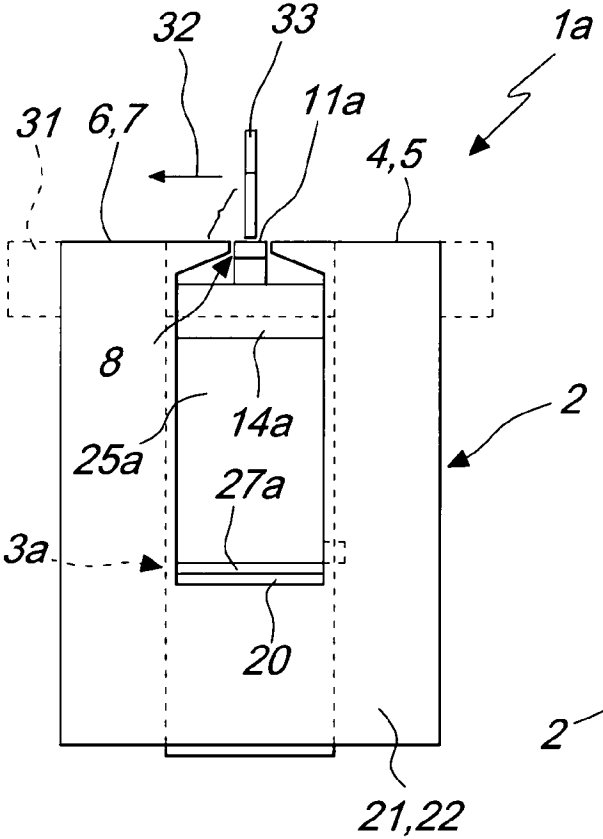

When the selection element 33 arrives at the discontinuity 8, 9, i.e., it faces with another portion the pole 11*a* of the selection electromagnet 3*a*, if the coil 14*a* is not supplied with power, the attraction of this pole 11*a*, produced by the permanent magnet 13*a*, retains the selection element 33 in the first position, as shown in FIG. 5. Then the selection element 33 faces the second pole or second pair of poles 6, 7 of the main magnet 2 which keeps the selection element 33 in the first position, as shown in FIG. 6.

It should be noted that the selection element 33 rests, in the first position, against the supporting element 31, which prevents its direct contact with the poles.

Figure 8:
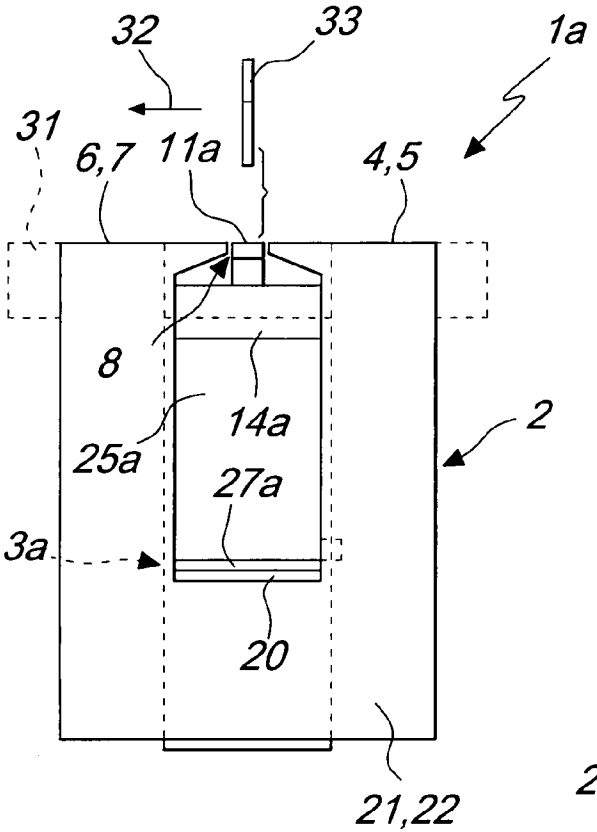

If instead the coil 14*a* is powered, the attraction force of the pole 11*a* of the selection electromagnet 3*a* is canceled out and the selection element 33 passes, due to the action of the spring 34, to the second position, i.e., moves away from the pole 11*a*, as shown in FIG. 8.

Figure 9:
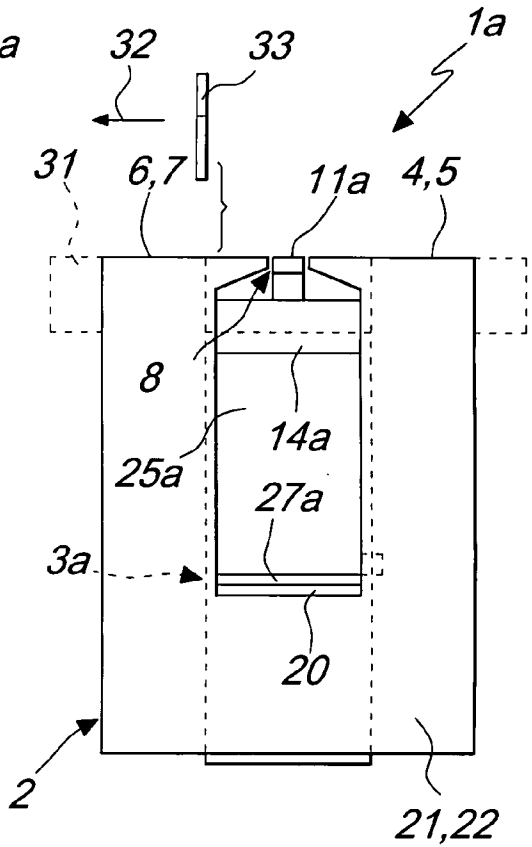
FIGS. 7 to 9 illustrate another actuation sequence of a selection element with the magnetic actuator according to the invention in the first embodiment in front view.

Subsequently, during transit at the second pole or second pair of poles 6, 7 of the main magnet 2, the selection element 33 remains in the second position, as illustrated in FIG. 9.

The different position assumed by the selection element 33 after its transit at the discontinuity 8, 9 and at the pole 11*a* of the selection electromagnet 3*a* is used to engage or disengage the selection element 33 with actuation elements, for example cams, in order to produce a different actuation of the element, which in the illustrated case is constituted by a needle 35, to which the selection element 33 is connected, and which is thus selected by means of the selection device.

Operation of the magnetic actuator in its second embodiment is similar to the operation described above with reference to the first embodiment, with the difference that in the first embodiment, due to the fact that the selection electromagnet 3*a* has a single yoke 25*a*, the magnetic circuit of the selection electromagnet 3*a* is closed on the selection element 33 by using the yoke 22 of the main magnet 2, whereas in the second embodiment the magnetic circuit of the selection electromagnet 3*b* is closed on the selection element 33 exclusively by means of the two yokes 29*b*, 30*b* of the selection electromagnet 3*b*.

The magnetic actuator according to the invention can also be provided in other embodiments included within the scope of the protection of the present invention, for example by providing the selection electromagnet 3*a*, 3*b* by means of a simple core made of ferromagnetic material instead of by means of a permanent magnet. Without altering the fact that the core of the selection electromagnet 3*a*, 3*b* can also have other shapes, said selection electromagnet 3*a*, 3*b* can also be provided substantially as described and illustrated with reference to the accompanying drawings, simply replacing with a core made of ferromagnetic material the permanent magnet 13*a*, 13*b* described with reference to said drawings. Optionally, the core of the selection electromagnet 3*a*, 3*b* can be formed monolithically with the yoke 25*a* or the yokes 29*b*, 30*b*.

In these additional embodiments, in which the selection electromagnet 3*a*, 3*b* does not have a permanent magnet, the operation of the magnetic actuator differs from the one described above in that when the selection element 33 is to be kept in the first position at the discontinuity 8, 9 of the main magnet 2, the coil 14*a*, 14*b* of the selection electromagnet 3*a*, 3*b* is powered so that an attraction force is generated at the pole 11*a*, 11*b*, 12*c*, while when the selection element 33 is to be passed from the first position to the second position the coil 14*a*, 14*b* of the selection electromagnet 3*a*, 3*b* is not powered.

In the magnetic actuator according to the invention, thanks to the fact that the pole 11*a* or poles 11*b*, 12*b* of the selection electromagnet 3*a*, 3*b* are spaced laterally from the discontinuity 8, 9 located between the poles or pairs of poles 4, 5 and 6, 7 of the main magnet 2, the interference of the magnetic field of the main magnet 2 on the selection electromagnet 3*a*, 3*b* is avoided or at least reduced significantly. In this manner, the selection electromagnet 3*a*, 3*b* is not affected, or at the most is affected to a minimal extent, by the variations induced in the magnetic field of the main magnet 2 by the different selection conditions of the selection elements 33. For this reason, it is much easier to size the coil 14*a*, 14*b* of the selection electromagnet 3*a*, 3*b* and determine exactly the intensity of the current for supplying the coil 14*a*, 14*b* so as to cancel out or reduce or generate the attraction force on the selection elements 33 produced by the selection electromagnet 3*a*, 3*b*.

Moreover, again thanks to this fact, in the magnetic actuator according to the invention it is possible to use, for the main magnet, more powerful permanent magnets with considerably larger gaps than those of known types of magnetic actuators, making greater production and assembly tolerances acceptable and therefore simplifying and reducing the cost of its production without requiring oversizing of the coil, which can maintain small dimensions.

The small dimensions of the coil and the fact that it is arranged outside the main magnet also allow to utilize better the space available for the installation of the magnetic actuator on the machine that it is meant to serve.

Finally, it should be noted that the considerably larger gaps that are possible with the magnetic actuator according to the invention allow the magnetic materials used to work in regions of the curve B (magnetic induction)—H (magnetizing field strength) which are linear, i.e., far from saturation conditions, making the actuator less sensitive to any variations in the supply conditions of these materials.

In practice it has been found that the magnetic actuator according to the invention fully achieves the intended aim, since it ensures high precision and reliability in operation and is simpler to manufacture and actuate than known types of magnetic actuators.

In the examples of embodiments described above, individual characteristics, given in relation to specific examples, may actually be interchanged with other different characteristics that exist in other examples of embodiments.

The magnetic actuator thus conceived is susceptible of numerous modifications and variations, all of which are within the scope of the appended claims; all the details may further be replaced with other technically equivalent elements.

In practice, the materials used, so long as they are compatible with the specific use, as well as the dimensions, may be any according to requirements and to the state of the art.

Where technical features mentioned in any claim are followed by reference signs, those reference signs have been included for the sole purpose of increasing the intelligibility of the claims and accordingly such reference signs do not have any limiting effect on the interpretation of each element identified by way of example by such reference signs.

What is claimed is:

1. A selection device for hosiery knitting machines or the like, wherein it comprises a magnetic actuator according to one or more of the preceding claims, with said at least two poles of the main magnet arranged sequentially along an actuation direction and selection elements which can be attracted magnetically and can move along said actuation direction with respect to said selection actuator in order to face sequentially a first one of said poles of the main magnet, then said discontinuity and said at least one pole of the selection electromagnet and then a second one of said at least two poles of the main magnet; said selection elements being movable from a first position, in which they are kept adjacent to said poles by the magnetic attraction applied by said poles, to a second position, in which they are further spaced from said poles with respect to said first position; said coil being suppliable with electric power in order to keep each selection element in said first position or allow the passage of each selection element from said first position to said second position upon its passage at said discontinuity and at said at least one pole of the selection electromagnet.

2. The device according to claim 1, wherein each selection element, in said first position, rests on said supporting element.

3. The device according to claim 1 or 2, wherein said selection element can move, in order to pass from said first position to said second position, on a plane which is substantially perpendicular to said actuation direction, due to the action of elastic means.

4. The device according to one or more of claims 1 or 2, wherein the faces of said poles of the main magnet and of the selection electromagnet that are directed toward said selection elements are substantially coplanar.

5. A magnetic actuator for selection devices in hosiery knitting machines, which comprises a main magnet having at least two poles arranged side by side and separated by a discontinuity, comprising a selection electromagnet, which is provided with at least one pole arranged in alignment with said discontinuity and spaced laterally with respect to said discontinuity, said selection electromagnet being actuatable to generate or eliminate or reduce a magnetic attraction force at said pole of the selection electromagnet.

6. The magnetic actuator according to claim 5, wherein said selection electromagnet is spaced laterally with respect to said main magnet.

7. The magnetic actuator according to claim 5, wherein said selection electromagnet comprises a core made of ferromagnetic material which forms, with one of its ends, said at least one pole of the selection electromagnet and an actuation coil which is wound around said core and can be supplied electrically in order to generate said magnetic attraction force at said at least one pole of the selection electromagnet.

8. The magnetic actuator according to claim 7, wherein said selection electromagnet comprises a permanent magnet, which is connected magnetically to said at least one pole in order to generate said magnetic attraction force at said at least one pole of the selection electromagnet, and at least one actuation coil, which can be supplied electrically in order to eliminate or reduce said magnetic attraction force at said at least one pole of the selection electromagnet.

9. The magnetic actuator according to claim 5, wherein said main magnet comprises a permanent magnet, which is sandwiched between two yokes which form, with their ends, two pairs of poles separated by said discontinuity.

10. The magnetic actuator according to claim 9, wherein each one of said two yokes of the main magnet is substantially U-shaped, with said discontinuity formed between the two free ends of the U-shape.

11. The magnetic actuator according to claim 10, wherein said permanent magnet of the main magnet is interposed between said two yokes proximate to the region connecting the two arms of the U-shape of the two yokes.

12. The magnetic actuator according to one of claims 7 to 11, wherein said permanent magnet or said core of the selection electromagnet is constituted by, or is connected to, a yoke which forms, with one of its ends, said at least one pole.

13. The magnetic actuator according to claim 12, wherein said coil is arranged around said yoke of the selection electromagnet.

14. The magnetic actuator according to claim 12, wherein the permanent magnet or core of said selection electromagnet is spaced, by means of a gap, from the yoke of the main magnet that lies proximate to said selection electromagnet in order to use said yoke of the main magnet as second yoke of the selection electromagnet.

15. The magnetic actuator according to claim 12, comprising an element for connecting, by means of a gap, said permanent magnet or said core of the selection electromagnet to the yoke of the main magnet proximate to said selection electromagnet.

16. The magnetic actuator according to claim 8, wherein said permanent magnet or said core of the selection electromagnet is connected to two yokes which form, with their ends, two poles which are aligned with each other and with said discontinuity.

17. The magnetic actuator according to claim 16, wherein said two poles of the selection electromagnet are arranged side by side along a direction which is substantially perpendicular to the direction along which the at least two poles of said main magnet are arranged side by side.

18. The magnetic actuator according to claim 16, wherein said coil is arranged around the permanent magnet or the core of said selection electromagnet.

19. The magnetic actuator according to claim 5, comprising a supporting element made of diamagnetic material, which forms a contact surface for elements that can be actuated by means of the magnetic actuator and is adapted to avoid direct contact of the actuated elements with said poles.

20. A selection device for hosiery knitting machines, comprising a magnetic actuator as set forth in claim 5, with said at least two poles of the main magnet arranged sequentially along an actuation direction and selection elements which can be attracted magnetically and can move along said actuation direction with respect to a selection actuator in order to face sequentially a first one of said poles of the main magnet, then the discontinuity and the at least one pole of the selection electromagnet and then a second one of the at least two poles of the main magnet; the selection elements being movable from a first position, in which they are kept adjacent to said poles by the magnetic attraction applied by said poles, to a second position, in which they are further spaced from said poles with respect to said first position; an actuation coil of said selection electromagnet being suppliable with electric power in order to keep each selection element in said first position or allow the passage of each selection element from said first position to said second position upon its passage at said discontinuity and at said at least one pole of the selection electromagnet.

21. The device according to claim 20, wherein each selection element, in said first position, rests on said supporting element.

22. The device according to claim 20, wherein the selection elements are movable, in order to pass from said first position to said second position, on a plane which is substantially perpendicular to said actuation direction, due to the action of elastic means.

23. The device according to claim 20, wherein faces of said poles of the main magnet and of the selection electromagnet that are directed toward said selection elements are substantially coplanar.

24. A magnetic actuator particularly for selection devices in hosiery knitting machines or the like, which comprises a main magnet which has at least two poles arranged side by side and separated by a discontinuity, comprising a selection electromagnet, which is provided with at least one pole arranged in alignment with said discontinuity and spaced laterally with respect to said discontinuity so that said at least one pole of said selection electromagnet is outside of said discontinuity that separates said at least two poles of said main magnet, said selection electromagnet being actuatable to generate or eliminate or reduce a magnetic attraction force at said pole of the selection electromagnet.

25. The magnetic actuator according to claim 24, wherein said selection electromagnet is spaced laterally with respect to said main magnet.

26. The magnetic actuator according to claim 24, wherein said selection electromagnet comprises a core made of ferromagnetic material which forms, with one of its ends, said at least one pole of the selection electromagnet and an actuation coil which is wound around said core and can be supplied electrically in order to generate said magnetic attraction force at said at least one pole of the selection electromagnet.

27. The magnetic actuator according to claim 24, wherein said selection electromagnet comprises a permanent magnet, which is connected magnetically to said at least one pole in order to generate said magnetic attraction force at said at least one pole of the selection electromagnet, and at least one actuation coil, which can be supplied electrically in order to eliminate or reduce said magnetic attraction force at said at least one pole of the selection electromagnet.

28. The magnetic actuator according to one or more of claims 24 to 27, wherein said main magnet comprises a permanent magnet, which is sandwiched between two yokes which form, with their ends, two pairs of poles separated by said discontinuity.

29. The magnetic actuator according to claim 28, wherein each one of said two yokes of the main magnet is substantially U-shaped, with said discontinuity formed between the two free ends of the U-shape.

30. The magnetic actuator according to claim 29, wherein said permanent magnet of the main magnet is interposed between said two yokes proximate to the region connecting the two arms of the U-shape of the two yokes.

31. The magnetic actuator according to one of claims 26 or 27, wherein said permanent magnet or said core of the selection electromagnet is constituted by, or is connected to, a yoke which forms, with one of its ends, said at least one pole.

32. The magnetic actuator according to claim 31, wherein said coil is arranged around said yoke of the selection electromagnet.

33. The magnetic actuator according to claim 31, wherein the permanent magnet or core of said selection electromagnet is spaced, by means of a gap, from the yoke of the main magnet that lies proximate to said selection electromagnet in order to use said yoke of the main magnet as second yoke of the selection electromagnet

34. The magnetic actuator according to claim 31, wherein it comprises an element for connecting, by means of a gap, said permanent magnet or said core of the selection electromagnet to the yoke of the maim magnet proximate to said selection electromagnet.

35. The magnetic actuator according to one of claims 26 or 27, wherein said permanent magnet or said core of the selection electromagnet is connected to two yokes which form, with their ends, two poles which are aligned with each other and with said discontinuity.

36. The magnetic actuator according to claim 35, wherein said two poles of the selection electromagnet are arranged side by side along a direction which is substantially perpendicular to the direction along which the at least two poles of said main magnet are arranged side by side.

37. The magnetic actuator according to claim 35, wherein said coil is arranged around the permanent magnet or the core of said selection electromagnet.

38. The magnetic actuator according to one of claims 24 to 27, wherein it comprises a supporting element made of diamagnetic material, which forms a contact surface for the elements that can be actuated by means of the magnetic actuator and is adapted to avoid direct contact of said elements with said poles.

* * * * *